US007111576B2

(12) United States Patent
Francis

(10) Patent No.: US 7,111,576 B2
(45) Date of Patent: Sep. 26, 2006

(54) ANCHOR WITH SMALLER SECOND FLUKE

(76) Inventor: Rex William Francis, 27 Dunstan Road, Avonsleigh, Victoria (AU) 3782

( * ) Notice: Subject to any disclaimer, the term of this patent is extended or adjusted under 35 U.S.C. 154(b) by 0 days.

(21) Appl. No.: 10/517,996

(22) PCT Filed: Jun. 16, 2003

(86) PCT No.: PCT/AU03/00800

§ 371 (c)(1),
(2), (4) Date: Dec. 15, 2004

(87) PCT Pub. No.: WO03/106252

PCT Pub. Date: Dec. 24, 2003

(65) Prior Publication Data

US 2005/0247253 A1 Nov. 10, 2005

(30) Foreign Application Priority Data

Jun. 18, 2002 (AU) ..... PS3014

(51) Int. Cl.
*B63B 21/32* (2006.01)

(52) U.S. Cl. ..... 114/301; 114/294

(58) Field of Classification Search ..... 114/294, 114/301

See application file for complete search history.

(56) References Cited

U.S. PATENT DOCUMENTS

| | | | | |
|---|---|---|---|---|
| 4,433,635 | A | 2/1984 | Takahashi | 114/301 |
| 4,706,595 | A * | 11/1987 | van den Haak | 114/301 |
| 4,869,193 | A | 9/1989 | Van Den Haak | 114/301 |
| 5,469,802 | A * | 11/1995 | Ivicevic | 114/301 |
| 5,970,902 | A * | 10/1999 | Francis | 114/301 |
| 6,082,284 | A * | 7/2000 | McCabe | 114/301 |

FOREIGN PATENT DOCUMENTS

AU 83142/98 6/2001

* cited by examiner

*Primary Examiner*—Lars A. Olson
(74) *Attorney, Agent, or Firm*—Andrus, Sceales, Starke & Sawall, LLP

(57) ABSTRACT

The present invention provides an improved anchor which is capable of being readily laid, irrespective of the holding or anchorage involved. The anchor includes a first fluke or base member (2), an elongate shank member (9) to which at least one anchor line or chain may be attached, and a second fluke (20) from and disposed substantially parallel to the first fluke (2) but is of a smaller size than the first fluke (2).

20 Claims, 3 Drawing Sheets

FIG. 5
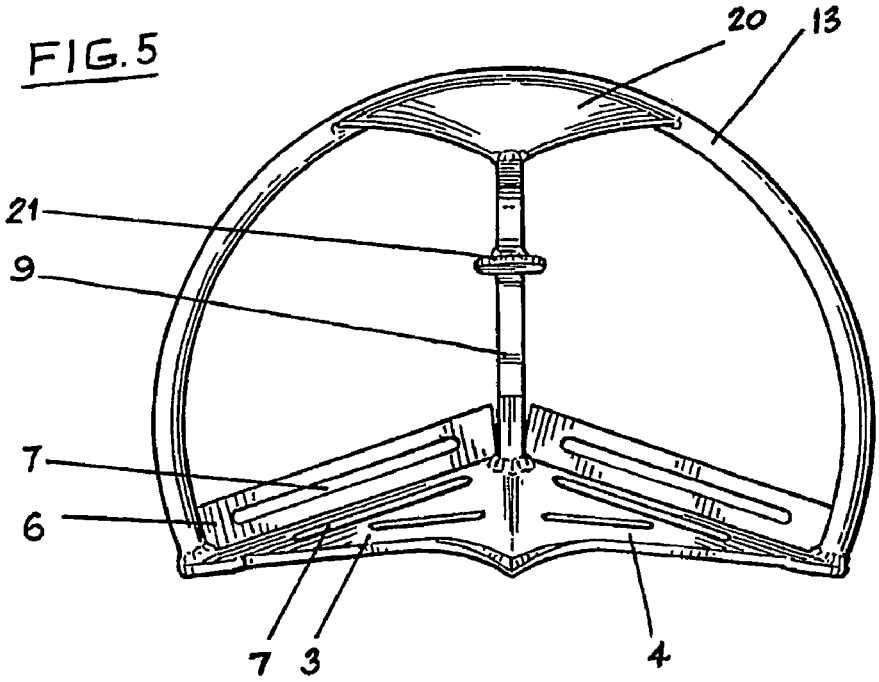
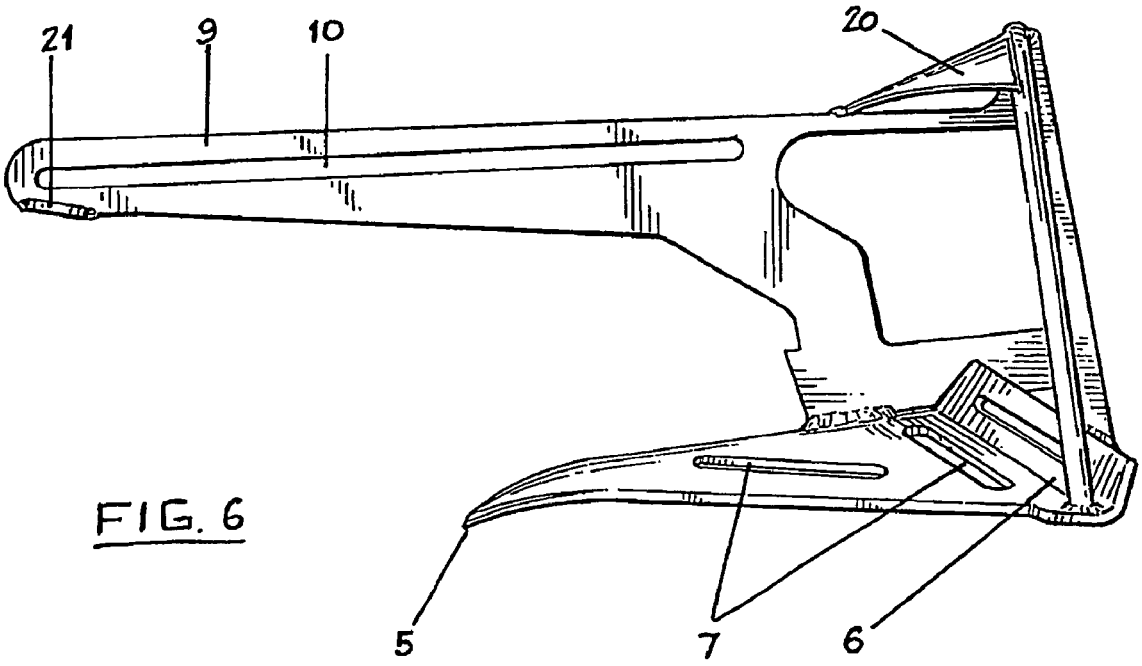
FIG. 6

ANCHOR WITH SMALLER SECOND FLUKE

CROSS-REFERENCE TO RELATED APPLICATIONS

This application is the U.S. national stage application of International Application PCT/AU03/00800, filed Jun. 16, 2003, which international application was published on Dec.24, 2003, as International Publication WO 03/106252 A1 in the English language. The International Application claims priority of Australian Patent Application PS 3014, filed Jun. 18, 2002.

BACKGROUND OF THE INVENTION

The present invention relates, in general terms, to improvements in anchors or means for anchoring. More particularly, but not exclusively, the invention relates to an improved form of anchor suitable for use in a variety of different contexts, for achieving effective anchoring regardless of the nature of the holding (be it sand, rock, coral or the like), whilst preferably at the same time allowing for ready release and re-setting of the anchor as and when desired.

For ease of explanation, throughout the ensuing specification reference will be made to an especially preferred embodiment of an anchor in accordance with the present invention, to be utilised for the purposes of anchoring a boat or the like water-borne vessel at any give locale. It should be realised, however, that an anchor in accordance with the present invention is equally suited for other purposes than for the mooring of boats, as by way of example the permanent or temporary mooring of buoys, drilling rigs and/or the like.

In particular the present invention relates to an improvement in the anchor disclosed in the present applicant's Australian Patent No. 734943.

The situation often arises wherein there is a need to anchor or moor boats, buoys, drilling rigs and/or any other form of vessel or water-borne body, either permanently or temporarily, in a given position or at a given locale. That need may, in turn, give rise to problems in that, dependent upon circumstances and the actual location, it has become necessary to anchor or moor such vessels or other bodies in different types of holdings. An anchor which might be particularly suitable for one type of holding, as for example sand or mud, need not be appropriate for another, different type of holding, as for example rock or coral. It has sometimes been the practice for the vessel owner/user to utilise a different form of anchor dependent upon the nature of the holding. Up until recently, prior to the advent of the present applicant's SARCA (Registered Trade Mark) anchor, the subject of Australian Patent No. 734943, there had not been available a multi-use, multi-purpose anchor. In the result, and in order to achieve the best or optimum anchoring result, a different form of anchor would often need to be deployed dependent upon the nature of the holding. That fact alone gave rise to problems, regardless of the size of the water-borne vessel, craft or the like to be anchored or moored. By way of example only, it was not particularly efficient to have the vessel or craft operator required to change the anchor to a different type dependent upon circumstances and the nature of the holding expected below, this especially taking into consideration the possible problems associated with the task of physically replacing one type of anchor for another. In this day and age, where it has become a reasonably common practice to have inexperienced persons in charge of vessels, such a task can be extremely difficult, with the consequences of its not being done properly potentially dangerous.

Conventional anchors, if disturbed, can tend to roll over and thereafter be disposed on the ocean/sea/river/lake bottom (or other holding) incorrectly, in effect the wrong way up. In reality prior art anchors, when so disturbed, would lie on their side and have a tendency to stay that way. Quite clearly when so disposed or deployed the efficiency of operation of the overall anchor can be expected to be significantly reduced, a totally unacceptable result. Furthermore, when so deployed there may be a tendency for the anchor to be dragged across the holding, giving rise to disturbance of sand, mud, dislodgment of rock unwanted, destruction of coral etc. Such can have a deleterious effect on the overall environment and, if the relevant vessel is being used, for example, for purposes of angling or fishing, such a disturbance to the holding/ocean bottom is again undesirable, since it can be expected to disturb the local sea-life, thereby reducing the chances of anything being caught.

A further problem/disadvantage associated with anchors in accordance with the known art has related to the tendency or possibility of such anchors inadvertently working their way free from the holding, regardless of the nature of such holding. Once an anchor works itself free from its holding, then the vessel associated therewith is totally susceptible to the vagaries of the tides, weather, etc. This can be especially unfortunate if, for example, the crew or passenger(s) of the vessel or craft are not aware of the fact that the anchor has worked loose, as for example if they are suitably inexperienced sleeping or otherwise occupied. An unanchored vessel can drift alarmingly, dependent upon the tides and prevailing weather conditions, leaving itself liable to all sorts of consequences, as for example beaching, being swept onto rocks or reefs, etc, all such consequences involving significant danger to the occupants of the vessel.

SUMMARY OF THE INVENTION

The present invention seeks to overcome the problems and disadvantages associated with the prior art by providing a form of anchor which lends itself to ready use regardless of the nature of the holding, includes fewer component parts and is hence both easier and cheaper to manufacture, exhibits an inherent ability to right itself or assume/resume the desired configuration even when disturbed, and yet affords increased safety and security, not to mention ease of overall operation/installation.

In accordance with one aspect of the present invention there is provided an improved anchor, including: a first fluke or base member, one end thereof constituting a leading end of said anchor and being adapted to assist in anchorage/embedding of said anchor within a given holding; an elongate shank member fixedly attached to said first fluke, said shank member being adapted to receive, and releasably retain, at least one anchor line; a second fluke associated with said shank member and adapted to be fixedly connected thereto, said second fluke being spaced apart from said first fluke and disposed substantially parallel thereto, and wherein said second fluke is of a smaller size than said first fluke.

In accordance with a further aspect of the present invention there is provided an improved anchor, said anchor including: a first fluke preferably having a substantially triangular-shape when viewed in plan, a vertex of said first fluke being adapted to assist in anchorage of said anchor within a given holding; an elongate shank member fixedly attached to said first fluke, said shank member being adapted to received, and releasably retain, at least one anchor line; a second fluke associated with said shank member and being adapted to be fixedly connected thereto, said second fluke being spaced apart from said first fluke and disposed substantially parallel thereto; and stabilising means adapted to be attached to said shank member and to both said first and second flukes, wherein said second fluke is of lesser size than said first fluke.

In accordance with another aspect of the present invention there is provided an improved re-settable anchor including: a first fluke preferably having a substantially triangular shape when view in plan, a vertex of said first fluke being adapted to assist in anchorage of said anchor within a given holding; an elongate shank member fixedly attached to said first fluke, said shank member being adapted to receive, and releasably retain, at least one anchor line; a second fluke associated with said shank member and adapted to be fixedly connected thereto, said second fluke being spaced apart from said first fluke and disposed substantially parallel thereto; stabilising means adapted to be attached to said first fluke, said shank and preferably said second fluke, and wherein said second fluke is of a lesser size than said first fluke.

BRIEF DESCRIPTION OF THE DRAWINGS

In order that the invention may be more clearly understood and put into practical effect reference will now be made to a preferred embodiment of an anchor in accordance with the invention. The ensuing description is given by way of non-limitative example only and is with reference to the accompanying drawings, wherein:

FIG. 5 is a front perspective or end view of a preferred embodiment of the anchor in accordance with the invention; and FIG. 6 is a side elavational view of the anchor of FIGS. 1 to 5.

DETAILED DESCRIPTION OF THE DRAWINGS

Figure 3:
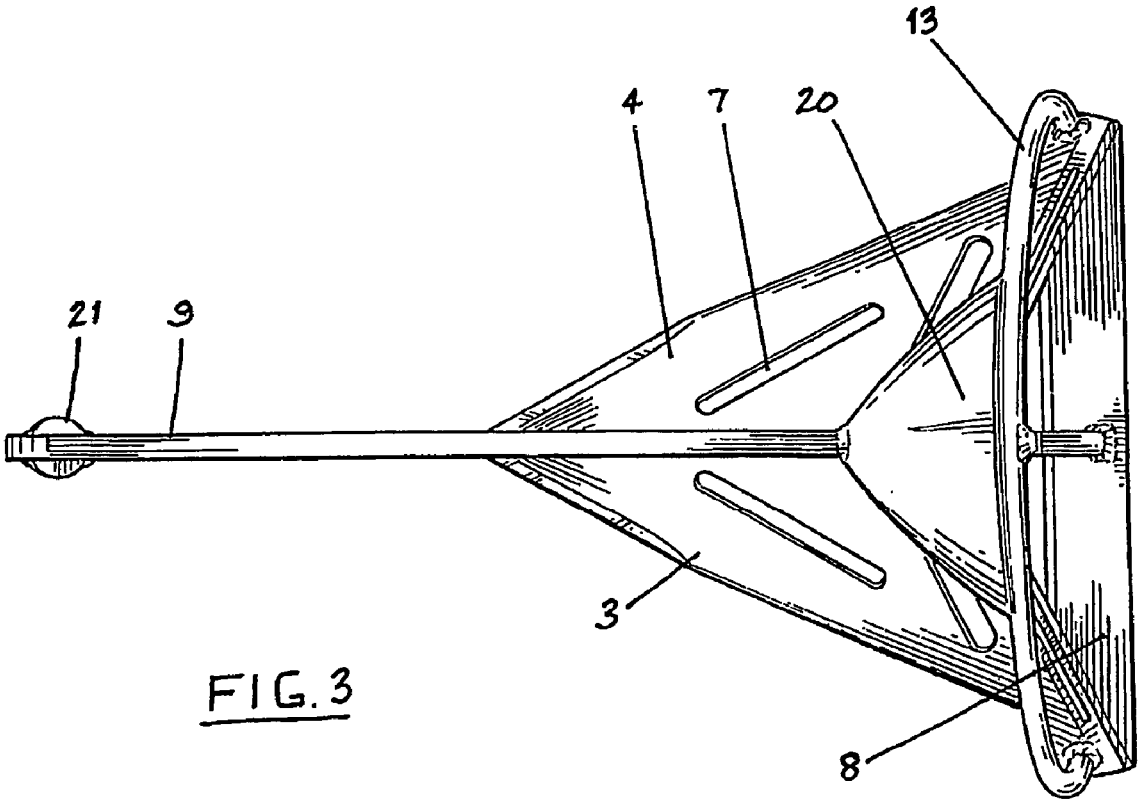
FIG. 3 is a top plan view of the anchor of FIGS. 1 and 2.
Figure 4:
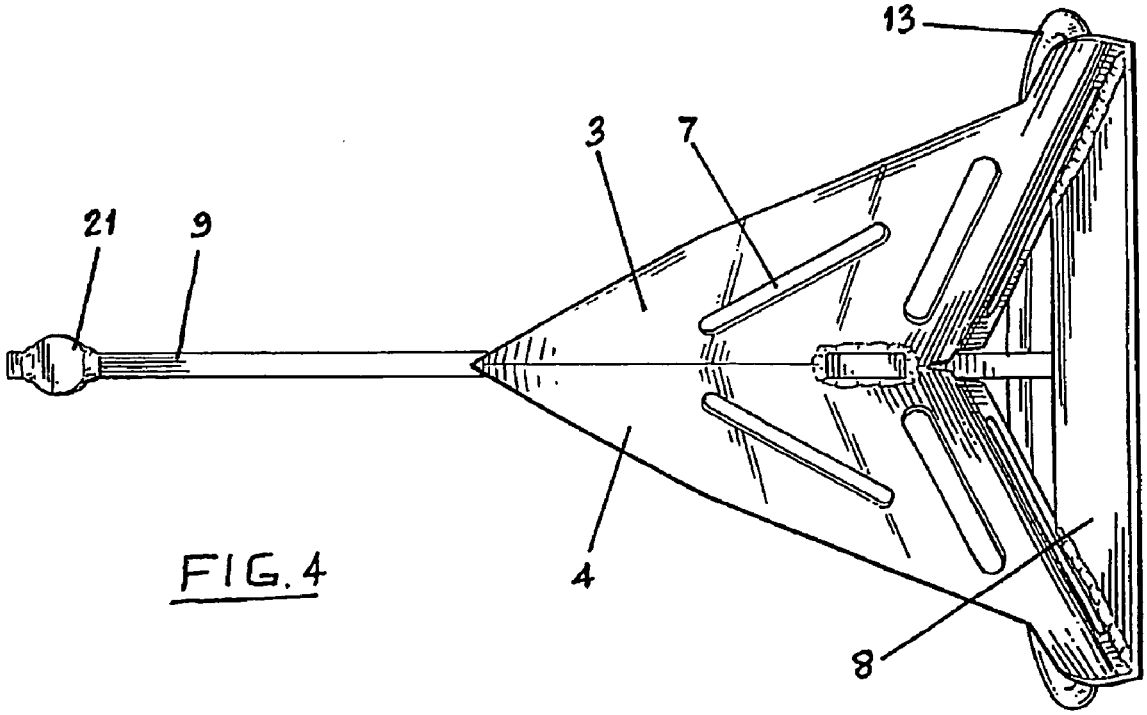
FIG. 4 is a underneath view of the anchor of FIGS. 1 to 3.

With particular reference now to the drawings, an anchor in accordance with the present invention, generally designated 1, is preferably of a shape which is substantially symmetrical about a central and vertically disposed plane (see for example FIGS. 3 and 5). The anchor 1 includes a base member or primary fluke 2 which, in the preferred embodiment illustrated, is formed from opposed substantially triangular-shape wing members 3 and 4 (when viewed in plan). Each of these wing members 3 and 4 has, at or in the vicinity of the vertex thereof, a downwardly turned portion 5, shaped so as to extend downwardly from the overall plane of each wing member 3, 4 whereby to provide, at the leading end of the primary fluke 2 (and therefore of the anchor), a portion whose function is to facilitate digging in of the overall anchor into the relevant holding, thereby to ensure proper anchorage therein. At the other end of each wing member 3, 4, in other words that end remote from the tip or vertex and associated downwardly turned portion 5, there is provided a further member 6 projecting upwardly and rearwardly from the overall plane of the associated wing member 3, 4 at an angle other than 90 degrees.

In the preferred embodiment illustrated each wing member 3, 4 has the longest side thereof constituting a free side edge of the overall anchor 1. The wing members 3, 4 are joined together along one side thereof at an angle one to the other. In the preferred embodiment illustrated each wing member 3, 4 is non-planar, with the wing members 3, 4 in fact being disposed at an angle to one another such that, when viewed in end elevation, the base member or primary fluke 2 formed thereby is substantially V-shaped.

The primary fluke 2 is preferably formed from a single sheet of a suitable metal, in any known manner and using any known apparatus. It must be realised, however, that the actual method of construction does not constitute a part of the invention.

As shown in the drawings, the respective wing members 3, 4 of the primary fluke 2, and preferably the rearwardly projecting members 6 thereof, each include therein one or more elongate slots or discontinuities 7. Such slots 7 have been found to assist in rapid sinking of the anchor, by allowing the passage of water therethrough. When it is desired to release an anchor from its holding, the existence of these slots 7 assists in breaking of the suction effect which acts to keep that anchor in place, thereby facilitating release of the overall anchor as and when desired. The very existence of these slots 7 can also give rise to a type of pumping action, more especially when the anchor is in use in rough seas and/or windy weather, in turn allowing for movement of sand, mud and the like from under the anchor whereby to afford an overall better anchorage.

Extending substantially laterally of the anchor 1 towards the rear or non-toe end thereof is a bracing member 8. Such bracing member 8 may be either formed integrally with the primary fluke 2 or, more preferably, be associated therewith as by welding. In the especially preferred embodiment illustrated that bracing member 8 extends substantially laterally of the overall anchor. The bracing member 8 is of a substantially planar shape, with opposed fixed ends being affixed to the uppermost free edge or side of the associated rearwardly projecting member 6 in any suitable manner, as for example by welding.

In the preferred embodiment illustrated the anchor 1 in accordance with the present invention includes a shank member, generally designated 9, which is fixably attached to both the primary fluke 2 and the bracing member 8 by any suitable means, as for example by welding.

In the especially referred embodiment illustrated the shank member 9 includes an elongate arm portion 10 preferably extending substantially parallel to the primary fluke 2 of the anchor 1 and spaced therefrom, and a leg member 11 attached to the primary fluke 2. Preferably the leg member 11 will be so shaped as to be in physical connection or contact—as for example by welding—with both the bracing member 8 and the primary fluke 2, the overall shank member 9 will be located substantially centrally of the primary fluke 2, or in other words of the overall anchor. The leg member 11 of the shank member 9 has a substantial void or discontinuity 12 therein. Such void or discontinuity 12 serves to reduce the overall weight of the anchor 1, yet at the same time increases the effectiveness thereof.

Again in the preferred embodiment illustrated an anchor in accordance with the present invention includes means, which are preferably releasably connectable thereto, which assist in balancing or self-righting of the overall anchor. Preferably such can take the form of a shaped hoop-like member 13, of a substantial semi-circular configuration as shown, which can be either releasably or permanently affixed to the primary fluke 2 in any known manner and using any suitable means.

According to one preferred embodiment of the present invention, not shown, the self-righting means 13 may be releasably attached to the primary fluke 2. In an alternative embodiment, not shown, the hoop-like member 13 will be fixed to the anchor using any suitable means, as for example welding.

In the preferred embodiment illustrated the arm portion 10 of the shank member 9 includes a shaped slot 14 extending longitudinally thereof, such slot 14 being adapted to receive, and preferably releasably retain, a shackle or the like means, as for example a D-shackle. The arrangement is such as to operate in the manner described in detail in the present applicant's Australian Patent No. 734943, whereby to allow for automatic re-setting of the anchor as and when necessary.

Figure 1:
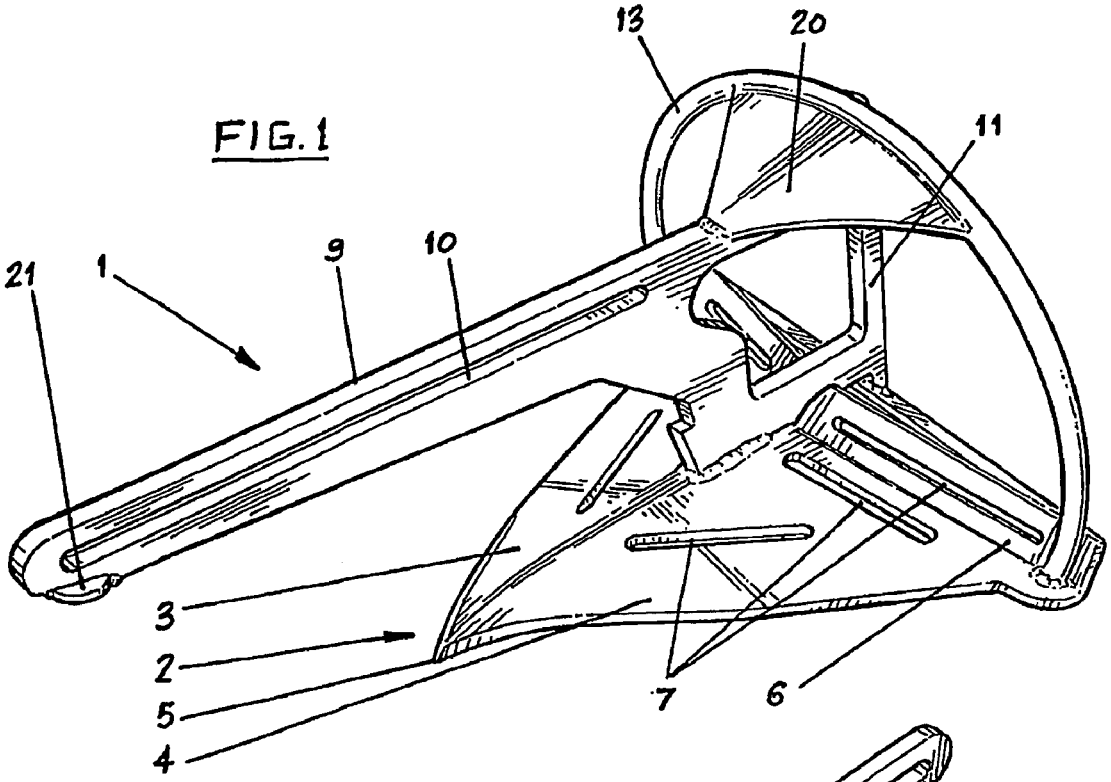
FIG. 1 is a front perspective view, of a preferred embodiment of an anchor in accordance with the present invention.
Figure 2:
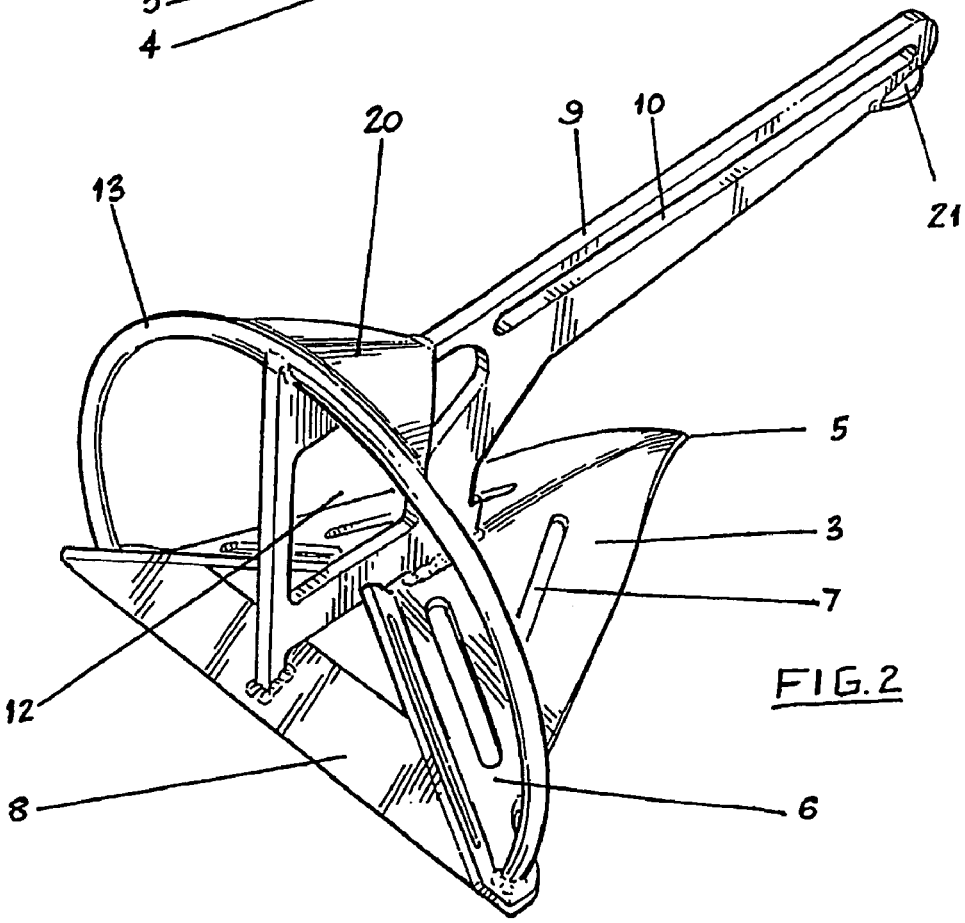
FIG. 2 is a rear perspective view of the anchor of FIG. 1.

The present applicant's arrangement further includes a secondary fluke, spaced apart from the primary fluke 2 and disposed substantially parallel thereto. In one embodiment, not shown, the secondary fluke may be associated with the uppermost free surface of the elongate arm member 10 of the shank member 9, being connected thereto in any known manner, as for example by welding. In an especially preferred embodiment, however, as illustrated for example in FIG. 1, the secondary fluke 20 is adapted, in use, to extend between the self-righting means 13 and the shank member 9. In that regard in the preferred embodiment illustrated the self-righting means 13 is affixed, at its uppermost extremity thereof, to a rear portion of the shank member 9 by any suitable means and in any suitable manner, as for example by welding. The secondary fluke 20 then extends between that self-righting means 13 and the shank member 9, adapted in use to be disposed substantially parallel to the primary fluke 2.

In use, the anchor in accordance with the present invention is intended to be embedded in the relevant holding. In the instance, however, of the anchor becoming disengaged from its holding, then the D-shackle will act to run along the slot 14 until such time as it impacts with the end thereof. In that regard it should be understood that, whilst this procedure of course occupies a finite time, in real terms the D-shackle impacts with the end of the slot 14 with quite a substantial force.

In one embodiment, not shown, strategically placed along the length of the arm portion 10 of the shank 9, at or in the vicinity of the free end thereof, may be a protrusion 21 of any given type and shape (as for example a pin or the like). This protrusion 21 acts, in use, to prevent the D-shackle from moving along or falling down the shank 9, more particularly along the underside thereof. In that regard it should be realised that, if such was allowed to happen, then a consequence thereof would be that the shackle and its associated chain, cable, chainrope or the like (collectively referred to as anchor line and not shown), could become jammed or fouled on the shank 9, hence preventing correct orientation of the overall anchor 1.

In an alternative embodiment, the slot 14 is substantially flat along the entire length thereof, with no sloping intermediate or joining section. Furthermore, and rather than employing a protrusion to prevent jamming or fouling of the D-shackle and its associated chain, a shaped member 21 is provided at or in the vicinity of the end of the shank 9. This shaped member also acts to prevent the D-shackle from travelling around the free end of the shank 9.

By virtue of the overall shape and configuration of the anchor 1, which can be seen to have the bulk of its weight at the end thereof remote from the free end of the shank 9, the impact of the D-shackle against the end of the slot 14 causes (or more correctly forces) the anchor 1 to be tipped up. When in that position or configuration, the D-shackle then runs in the reverse direction along the slot 14, to return to the other end thereof, causing the overall anchor 1 to be brought back, lifting the back of the anchor 1, thereby allowing the overall anchor 1 to re-set itself in the holding. It should be realised that this entire operation takes place automatically, without any need for human intervention. This is in marked contrast to the prior art procedures previously employed, which required retraction of the anchor to the surface, and then subsequent re-setting thereof.

The arrangement in accordance with the present invention, utilising or employing the secondary fluke 10, is responsible for a number of important practical advantages when compared with the known art.

Firstly, tests have shown that an anchor 1 in accordance with the present invention, when thrown over the side of a vessel, will right itself to ensure that it first lands on the surface of the relevant holding the right way up, thereby to ensure embedding thereof, regardless of the actual spatial disposition of the anchor 1 when first thrown. Such means that an improved and appropriate anchorage will be achieved regardless of the "skill" or experience of the person actually responsible for laying out the anchor 1 itself. In actual fact there is no skill or real prior experience needed in order to achieve a satisfactory result. This is in contrast to the prior art arrangements.

The present applicant's arrangement, by its very configuration, is substantially proof against the possibility of becoming entangled or caught-up on weed or the like sometimes resident on a give holding. The secondary fluke 20 acts to prevent mud and other extraneous and unwanted material from building up on the self-righting hoop means 13 and associated shank 9 of the anchor 1, thereby ensuring that the anchor can be readily released from the holding as and when desired.

In the present applicant's arrangement the primary fluke 2 is also cut away so as to be of a smaller overall size when compared with similar prior art arrangements. This allows the toe end of the anchor 1 to dig in to a given holding quicker and more readily.

In the past there have occurred instances wherein an anchor 1 has been dragged upside down through mud or the like making up the holding. The present applicant's arrangement, with its spaced-apart first and second flukes 2 and 20, is so configured that water pressure will act to assist in lifting of the overall anchor 1 from mud or the like, even in the instance of it somehow having been disposed the wrong way up therein.

The prior art anchors, as for example that the subject of the present applicant's Australian Patent No. 734943, have been found to suffer from the practical disadvantage that, in use, can accumulate substantially amounts of weed and the like material. Such a build-up or accumulation can result in the anchor not being able to right itself properly. The self-righting means (hoop), when not protected by a secondary fluke as in the arrangement of the present invention, can reasonably readily attach itself—or be "hooked" over—a piece of reef, for example, preventing readily release and self-righting.

When the anchor is located upside down, for example, in a holding such as soft mud, the secondary fluke in effect acts as a lifting device as the overall anchor is dragged by the vessel. Mud is actually pushed forward, ahead of the secondary fluke itself, the result being that the anchor is lifted out of the mud, allowing it to turn over and set itself properly, or be released if required.

Further, when the anchor 1 is buried in a sand holding, the secondary fluke enhances the overall holding power, giving rise to an increase in downward force acting on the overall anchor. This additional downward-acting force due to the existence of the secondary fluke has been found to increase the performance of the overall anchor to such an extent that it can actually pivot through a full 360° without pulling out or separating from the holding. As such, the present anchor is especially suited for mooring purposes.

Finally it should be understood that the aforegoing description refers merely to preferred embodiments of the present applicant's arrangement and that variations and modifications wills be possible thereto without departing from the spirit and scope of the invention, the ambit of which is to be determined from the following claims.

What is claimed is:

1. An improved anchor, comprising: a first fluke or base member, one end thereof constituting a leading end of said anchor and being adapted to assist in anchorage/embedding of said anchor within a given holding; an elongate shank member fixedly attached to said first fluke, said shank member being adapted to receive, and releasably retain, at least one anchor line; stabilizing means associated with said first fluke or base member, said stabilizing means including a member which is substantially semi-circular in shape, said stabilizing means serving to ensure that said anchor readily assumes an operating configuration and is restored to said operating configuration even after having been disturbed therefrom: and a second fluke associated with said shank member and adapted to be fixedly secured to the uppermost surface of said shank member and to said stabilizing means, said second fluke being spaced apart from said first fluke and disposed substantially parallel thereto, and wherein said second fluke is of a smaller size than said first fluke.

2. The anchor as claimed in claim 1, wherein said first fluke or base member has a substantial triangular shape when viewed in plan, with a vertex of said triangular shape constituting the leading end of said anchor, said first fluke or base member being formed from two opposed wing members, each substantially triangularly shaped when viewed in plan, said opposed wing members being joined along a line constituting a centre-line for said anchor, said opposed wing members being disposed at an angle to one another such that, when viewed in end elevation, said first fluke or base member has a substantial V-shape, and wherein each of said opposed wing members includes, at a leading end thereof, a down-turned portion which constitutes part of said leading end of said anchor for assisting in digging in or bedding in of said anchor in the holding.

3. The anchor as claimed in claim 2, comprising means for re-setting thereof, said means for re-setting including a slot extending substantially longitudinally of said shank member and along at least a part of the length of said shank member, said slot being adapted to receive, and releasably retain, a shackle means for the anchor line.

4. The anchor as claimed in claim 3, wherein said stabilizing means is attached to both said first fluke or base member and said shank member.

5. The anchor as claimed in claim 4, wherein said stabilizing means is fixedly secured to said shank member at a leading end of said shank member and to opposite sides of said first fluke or base member.

6. The anchor as claimed in claim 5, wherein each wing member comprises, at a trailing end thereof remote from said down-turned portion, a further member extending upwardly and at an angle to each respective wing member.

7. The anchor as claimed in claim 6, wherein said angle is other than 90°.

8. The anchor as claimed in claim 7, wherein each said wing member comprises at least one discontinuity therein.

9. The anchor as claimed in claim 8, wherein said further member of each said wing member comprises at least one discontinuity therein.

10. The anchor as claimed in claim 9, wherein each wing member has a free edge constituting a side of said anchor and being beveled.

11. The anchor as claimed in claim 10, including a bracing member extending between said further members of said wing members, and at the rear of said further members.

12. The anchor as claimed in claim 11, wherein said shank member is fixedly attached to both said first fluke or base member and said bracing member.

13. The anchor as claimed in claim 12, wherein said stabilizing means is in the form of a tubular member having a substantially semi-circular shape with opposed free ends being fixedly attached to said bracing member.

14. The anchor as claimed in claim 13, wherein said shank member comprises an arm portion extending substantially parallel to said base member, and a leg portion connecting to said base member.

15. The anchor as claimed in claim 14, wherein said leg portion of said shank member comprises at least one discontinuity therein.

16. The anchor as claimed in claim 15, wherein said shackle means is free to move along said slot of said shank member responsive to changes in disposition of said anchor relative to the holding.

17. The anchor as claimed in claim 16, comprising means for preventing said shackle means, and an anchor line connected thereto, from being disposed on an underside of said arm portion of said shank member whereby to avoid fouling of said anchor by the anchor line.

18. The anchor as claimed in claim 17, wherein said means for avoiding fouling is at least one projection extending laterally from said arm portion of said shank member and located in the vicinity of a free end of said arm portion.

19. The anchor as claimed in claim 18, including at least one notch in an underside of said leg portion of said shank member.

20. The anchor as claimed in claim 19, comprising at least one slot in an underside of said leg portion of said shank member.

* * * * *